US008851097B2

(12) United States Patent
Vieira et al.

(10) Patent No.: US 8,851,097 B2
(45) Date of Patent: Oct. 7, 2014

(54) INFANT SEAT COVER

(75) Inventors: Michael C. Vieira, Fall River, MA (US); Robert Monahan, Norwell, MA (US)

(73) Assignee: Monahan Products, LLC, Hingham, MA (US)

( * ) Notice: Subject to any disclaimer, the term of this patent is extended or adjusted under 35 U.S.C. 154(b) by 241 days.

(21) Appl. No.: 12/882,851

(22) Filed: Sep. 15, 2010

(65) Prior Publication Data

US 2012/0062000 A1 Mar. 15, 2012

(51) Int. Cl.

| | |
|---|---|
| ***E04H 15/40*** | (2006.01) |
| ***A47C 7/66*** | (2006.01) |
| ***A47C 31/11*** | (2006.01) |
| ***A47C 29/00*** | (2006.01) |

(52) U.S. Cl.

CPC ..... *A47C 31/11* (2013.01); *A47C 29/00* (2013.01); *A47C 7/66* (2013.01); *E04H 15/40* (2013.01)

USPC ..... 135/126; 135/88.02; 135/96; 297/184.15; 297/219.12; 280/647

(58) Field of Classification Search

USPC ..... 135/88.01, 88.02, 96, 125–128, 114, 135/117, 120.2–120.3, 907; 297/184.1, 297/184.13–184.15, 184.17, 219.1; 403/292, 297, 304–305, 359.3; 280/642, 647; 385/62, 67, 77, 81; 24/193, 297–300, 115 R, 115 A, 115 K; 439/344, 345, 352; 160/370.21, 369, 160/377

See application file for complete search history.

(56) References Cited

U.S. PATENT DOCUMENTS

| | | | | |
|---|---|---|---|---|
| 692,501 | A | 2/1902 | Bentley | |
| 1,039,993 | A | 10/1912 | Murphy | |
| 1,143,774 | A | 7/1915 | Nicholls | |
| 1,257,206 | A | 2/1918 | Fernbach | |
| 1,339,527 | A | 5/1920 | Sperling et al. | |
| 1,412,935 | A | 4/1922 | Greenebaum | |
| 1,732,878 | A | 10/1929 | Collender | |
| 2,129,080 | A | 9/1938 | Bramnick | |
| 3,227,484 | A | 1/1966 | Merclean | |
| 3,435,642 | A * | 4/1969 | Pesco | 70/49 |
| 3,675,667 | A | 7/1972 | Miller | |
| 3,917,302 | A | 11/1975 | Gebhard | |
| 3,960,161 | A | 6/1976 | Norman | |
| 4,037,614 | A * | 7/1977 | Hines et al. | 296/102 |
| 4,533,170 | A | 8/1985 | Banks et al. | |

(Continued)

FOREIGN PATENT DOCUMENTS

| | | | | |
|---|---|---|---|---|
| GB | 2329156 | A | 3/1999 | |
| GB | 2349566 | A | 8/2000 | |
| WO | WO 03041542 | A1 * | 5/2003 | A47G 9/06 |

OTHER PUBLICATIONS

Notification of Transmittal of the International Search Report and the Written Opinion of the International Searching Authority dated Jan. 6, 2012 for Application No. PCT/US2011/051391.

*Primary Examiner* — Winnie Yip
(74) *Attorney, Agent, or Firm* — Lando & Anastasi, LLP

(57) ABSTRACT

A seat cover includes a frame and cover. The frame includes a flexible member with a first end and a second end, a first connector configured to receive the first end of the flexible member, a second connector configured to receive the second end of the flexible member, and a support configured to receive the first connector and the second connector.

23 Claims, 9 Drawing Sheets

(56) References Cited

U.S. PATENT DOCUMENTS

| | | | | | |
|---|---|---|---|---|---|
| 4,582,355 | A | | 4/1986 | Hall | |
| 4,945,584 | A | | 8/1990 | LaMantia | |
| 4,978,166 | A | | 12/1990 | James | |
| 5,035,460 | A | * | 7/1991 | Huang | 296/95.1 |
| 5,074,616 | A | | 12/1991 | Smith | |
| 5,104,134 | A | | 4/1992 | Cone | |
| 5,116,273 | A | | 5/1992 | Chan | |
| 5,137,044 | A | | 8/1992 | Brady | |
| 5,163,461 | A | | 11/1992 | Ivanovich et al. | |
| 5,168,889 | A | | 12/1992 | Diestel | |
| 5,184,865 | A | | 2/1993 | Mohtasham et al. | |
| 5,277,148 | A | | 1/1994 | Rossignol et al. | |
| 5,411,315 | A | | 5/1995 | Greenwood | |
| 5,522,639 | A | | 6/1996 | Jaime | |
| 5,542,732 | A | | 8/1996 | Pollman | |
| 5,638,852 | A | * | 6/1997 | Dean | 135/136 |
| 5,676,168 | A | * | 10/1997 | Price | 135/126 |
| 5,730,490 | A | | 3/1998 | Mortenson | |
| 5,816,278 | A | | 10/1998 | Kim | |
| 5,934,529 | A | * | 8/1999 | O'Brien | 224/160 |
| 5,975,558 | A | | 11/1999 | Sittu | |
| 5,975,613 | A | | 11/1999 | Sippel | |
| 6,012,756 | A | | 1/2000 | Clark-Dickson | |
| 6,039,393 | A | | 3/2000 | Roh | |
| 6,068,322 | A | | 5/2000 | Kuester | |
| 6,109,282 | A | | 8/2000 | Yoon | |
| 6,155,628 | A | | 12/2000 | Williams | |
| 6,170,100 | B1 | * | 1/2001 | Le Gette et al. | 5/417 |
| 6,217,099 | B1 | | 4/2001 | McKinney et al. | |
| 6,224,073 | B1 | | 5/2001 | Au | |
| 6,290,527 | B1 | * | 9/2001 | Takaya et al. | 439/352 |
| 6,302,127 | B1 | * | 10/2001 | Gayton | 135/124 |
| 6,371,553 | B1 | * | 4/2002 | Tang | 297/184.1 |
| 6,513,827 | B1 | | 2/2003 | Barenbrug | |
| 6,517,153 | B1 | | 2/2003 | Brewer | |
| 6,527,294 | B1 | | 3/2003 | Brewington et al. | |
| 6,595,227 | B2 | * | 7/2003 | Le Gette et al. | 135/126 |
| 6,607,235 | B2 | * | 8/2003 | McGrath, Jr. | 296/136.1 |
| D481,976 | S | | 11/2003 | Everett | |
| 6,652,191 | B2 | * | 11/2003 | Moga | 405/186 |
| D486,098 | S | | 2/2004 | Church | |
| D486,099 | S | | 2/2004 | Chen | |
| 6,851,136 | B2 | | 2/2005 | Brereton | |
| 7,029,311 | B2 | * | 4/2006 | Peloza | 439/357 |
| 7,048,333 | B2 | * | 5/2006 | Martinez | 297/184.11 |
| 7,137,399 | B1 | | 11/2006 | Ransom et al. | |
| 7,150,499 | B2 | | 12/2006 | McGregor | |
| 7,174,584 | B2 | * | 2/2007 | Danaher | 5/414 |
| 7,467,589 | B2 | * | 12/2008 | Arias | 108/90 |
| 7,698,787 | B2 | | 4/2010 | Scroggie et al. | |
| 7,708,339 | B2 | | 5/2010 | Zapater | |
| 2003/0056817 | A1 | * | 3/2003 | Miller et al. | 135/117 |
| 2006/0054207 | A1 | * | 3/2006 | Wootliff | 135/96 |

* cited by examiner

INFANT SEAT COVER

TECHNICAL FIELD

This disclosure relates to infant seat covers.

BACKGROUND

An infant seat is generally configured to hold a baby or child. The seat may be attached to or part of a stroller or automobile. A baby or child generally sits in the seat and may be exposed to sun, rain, snow, dust, insects or other elements.

SUMMARY

This disclosure provides a frame for supporting a seat cover. In one aspect, the frame includes a flexible member with a first end and a second end. A first connector is configured to receive the first end of the flexible member, and a second connector is configured to receive the second end of the flexible member. A support is configured to receive the first connector and the second connector.

In some implementations, the flexible member is a wire. The wire may be made of steel. In other implementations, the first connector is configured to define a recess to receive the first end of the flexible member. The second connector may also be configured to define a recess to receive the second end of the flexible member. In another implementation, the first connector includes an arm that extends from the first connector. The second connector may also include an arm that extends from the second connector. In other implementations, the support defines one or more recesses for receiving one or more arms.

In another aspect, the frame includes a flexible member and a tube covering part of the flexible member. The tube may be made of plastic.

In another aspect, the frame includes a cover. The cover may be configured to attach to the flexible member or the support. The cover may be made of a woven fabric.

In another aspect, a seat cover includes a frame and a cover configured to attach to part of the frame. The frame includes a flexible member with a first end and a second end, a first connector configured to receive the first end of the flexible member, a second connector configured to receive the second end of the flexible member, and a support configured to receive the first connector and the second connector.

Implementations of the disclosure may include one or more of the following features. The flexible member may be a wire and the wire may be made of steel. The first connector may be configured to define a recess to receive the first end of the flexible member. The second connector may be configured to define a recess to receive the second end of the flexible member. The first connector may include an arm that extends from the first connector. The second connector may include an arm that extends from the second connector. The support may define one or more recesses for receiving one or more arms.

In another aspect, a seat cover includes a tube covering part of the flexible member. The tube may be made of plastic.

In another aspect, a seat cover includes a cover configured to attach to the support.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1A:
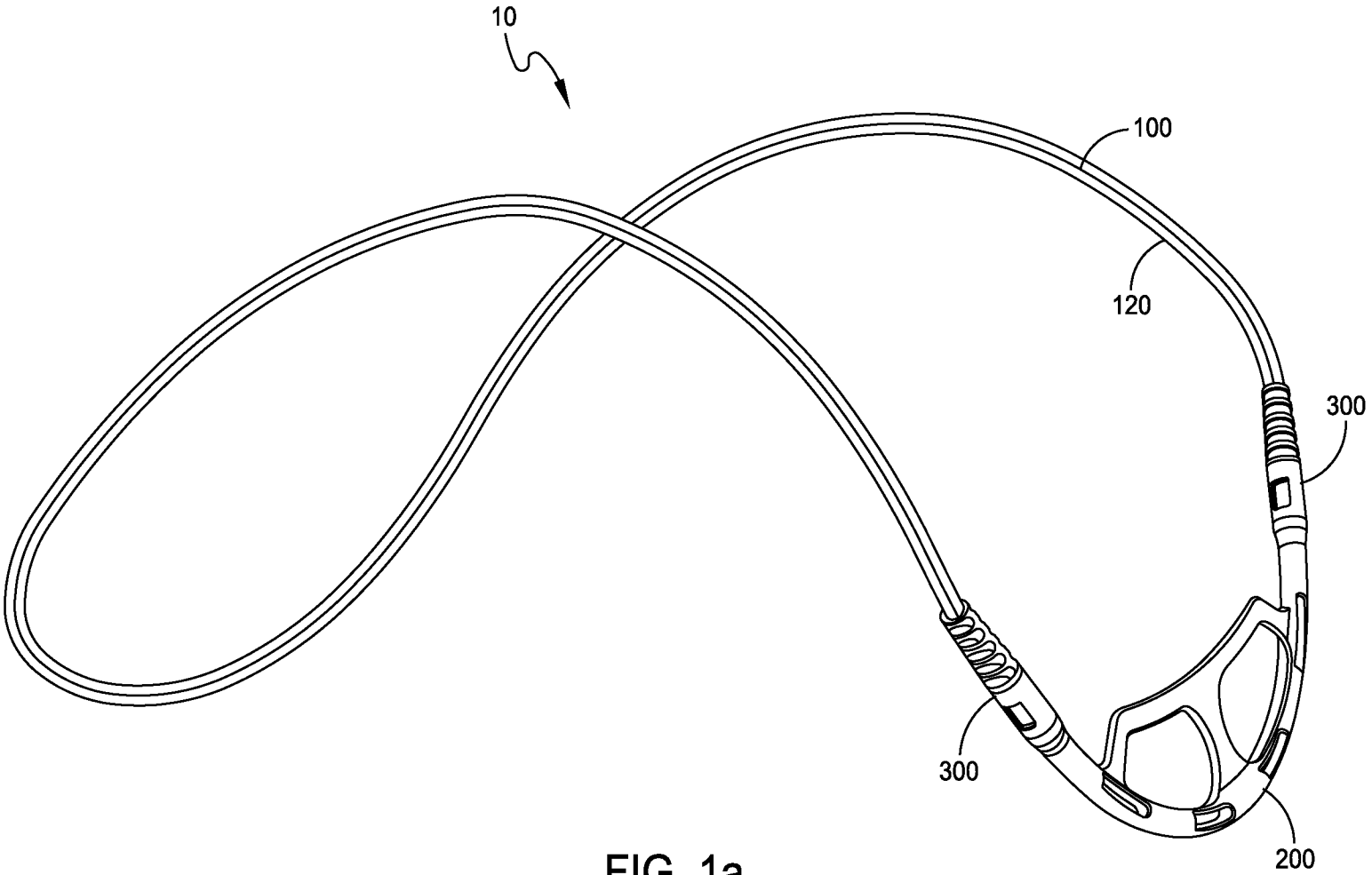
FIG. 1*a* is a side perspective view of a seat cover frame.
Figure 1B:
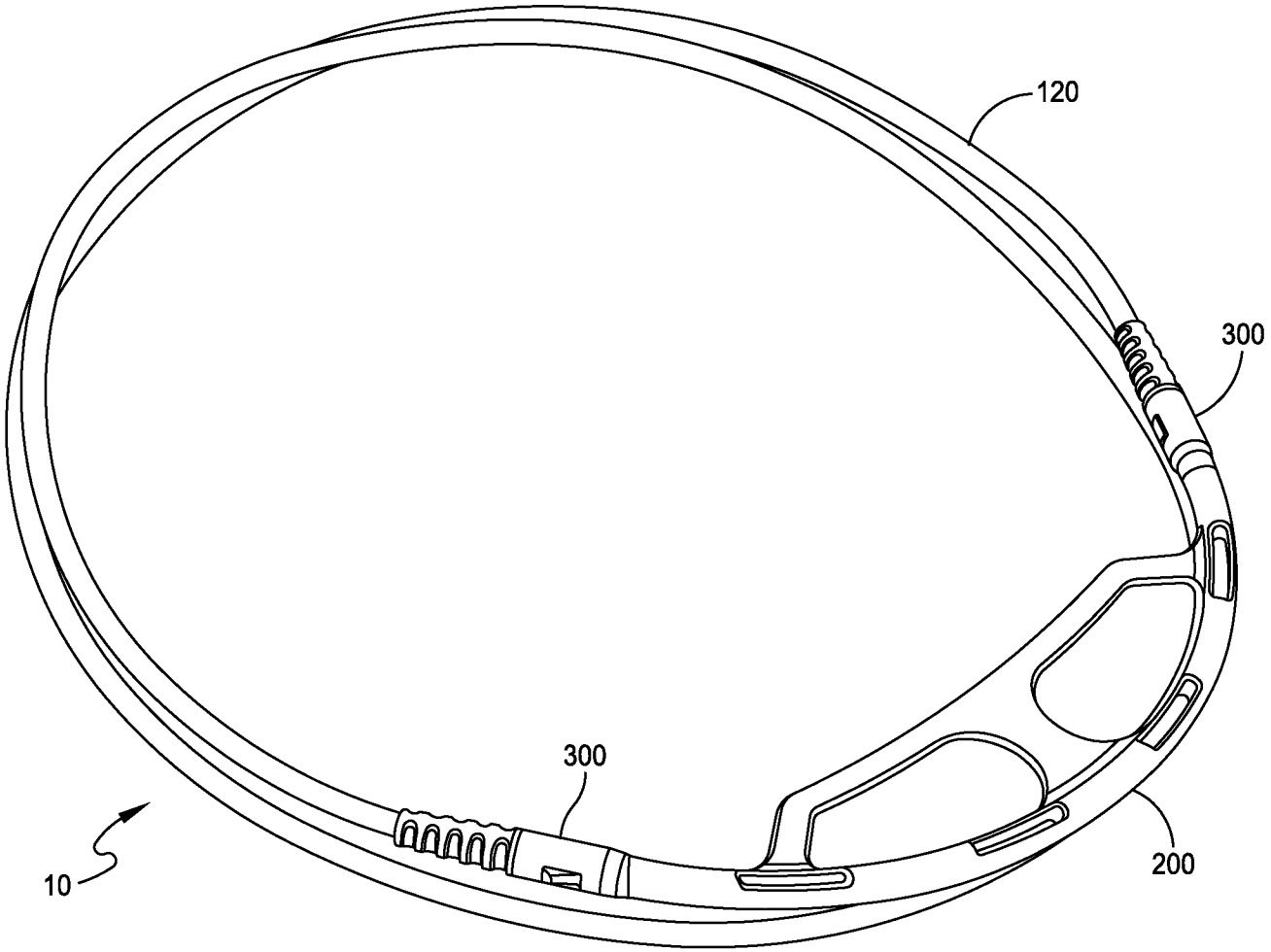
FIG. 1*b* is a side perspective view of a seat cover frame.

Referring to FIGS. 1*a* and 1*b*, in some implementations, a seat cover frame 10 includes a wire 100, a frame member 200 and a wire retainer 300. The seat cover frame 10 may be adjustable or otherwise adaptable to be used on various types of seats, including infant stroller seats and car seats. The wire 100 may be flexible to conform to different shapes, including the shape of a cover as shown in FIG. 1*a*. The wire 100 may be twisted into a compact position for storage, as shown in FIG. 1*b*. In the example shown, the wire 100 may be made of steel or any other suitable material and may be partially enclosed in a tube 120. The tube may be made of polyethylene or other suitable material. In other implementations, the wire 100 may be coated with plastic or any other suitable material, or may have a sheathing. The wire 100 includes first and second ends 101, 102, not shown. The wire retainer 300 is configured to hold first and second ends 101, 102 of the wire 100 and the tube 120. The wire retainer 300 is also configured to be inserted into the frame member 200. In the example shown, the wire retainer 300 helps maintain the proper orientation of the wire 100 and helps prevent rotation of the wire 100.

In other implementations, a seat cover frame may be comprised of two wires 100, four wire retainers 300 and two frame members 200. Each wire 100 has two ends, each one of which is configured to attach to wire retainer 300. Each wire retainer 300 is configured to attach to one of the frame members 200.

In other implementations, a seat cover frame may be comprised of a wire 100 and a frame member 200, where the frame member 200 includes a wire retainer 300 as part of the frame member 200.

Figure 2:
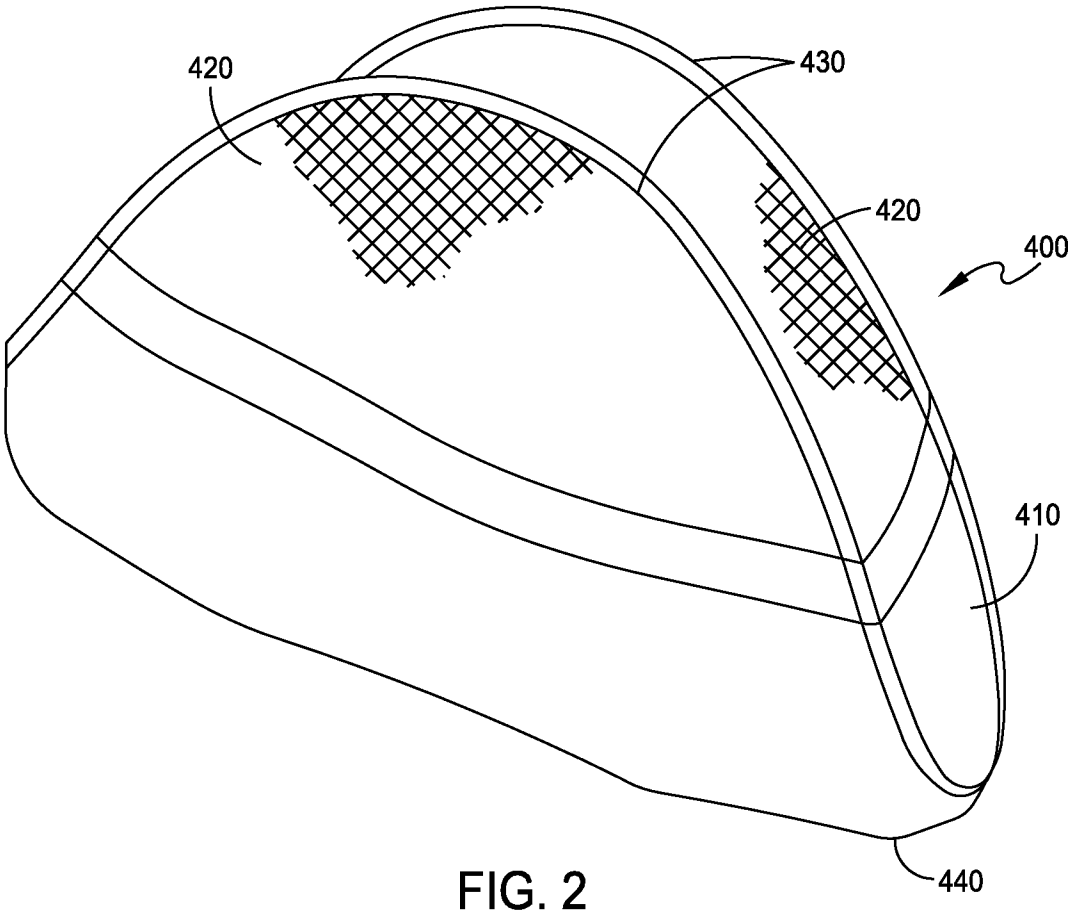
FIG. 2 is a side perspective view of a seat cover.

Referring to FIG. 2, in some implementations, a seat cover 400 may be constructed from cloth, plastic, or any other suitable material. In the example shown, the seat cover 400 comprises a woven fabric 410 and netting 420. The woven fabric 410 may be synthetic and may be waterproof or water resistant. The seat cover frame 10 supports the seat cover 400. The seat cover 400 includes seams 430 for inserting the wire 100 and elastic 440 for covering the frame member 200.

Figure 3A:
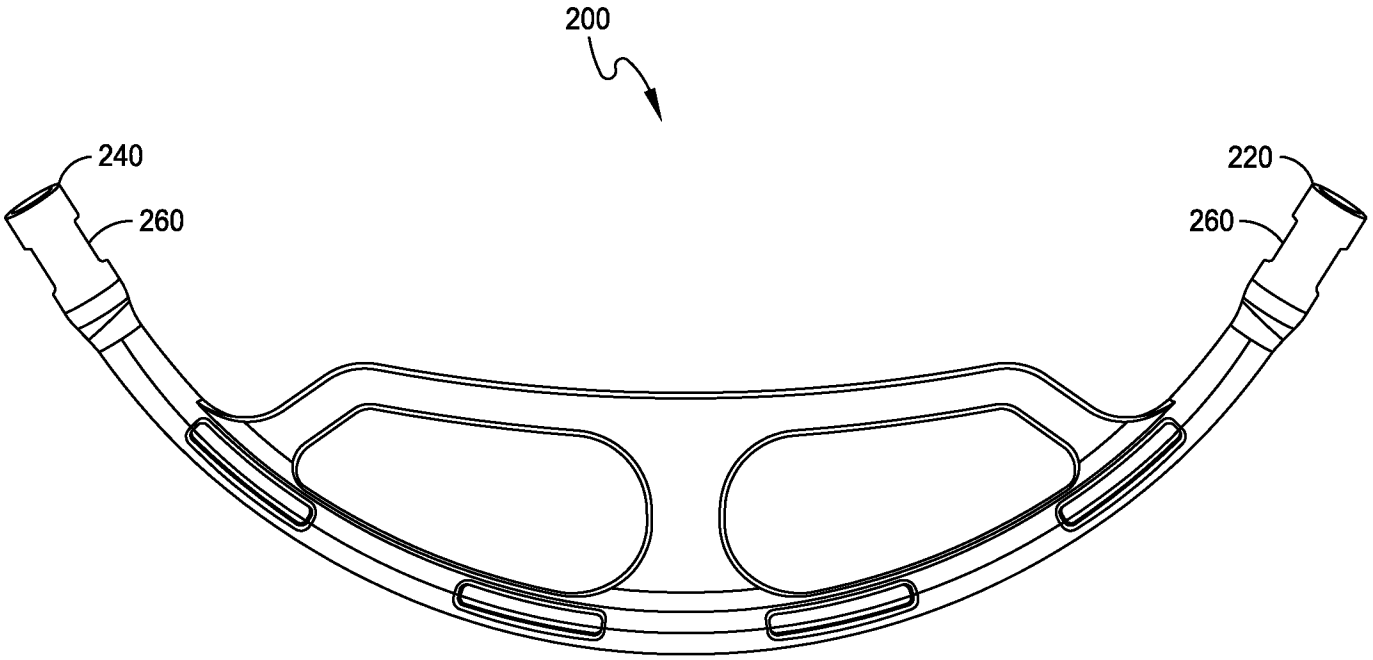
FIG. 3*a* is a front view of a frame member.
Figure 3B:
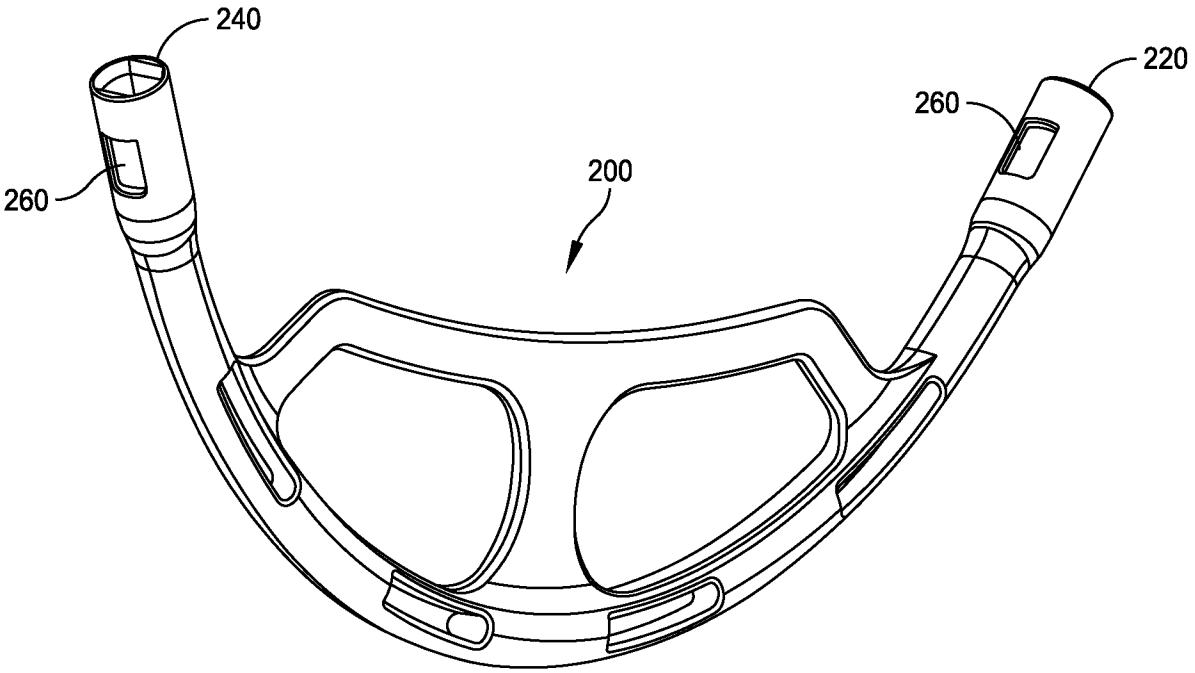
FIG. 3*b* is a side perspective view of a frame member.

Referring to FIGS. 3*a* and 3*b*, in some implementations, the frame member 200 may be constructed of plastic, or any other suitable material. The exemplary frame member 200 shown defines a substantially U-shape from a front view; however, other shapes and configurations are possible. The frame member 200 includes a first connector 220 and a second connector 240. The first and second connectors 220, 240 are configured to receive the wire retainers 300. The first and second connectors 220, 240 include openings 260.

Figure 4:
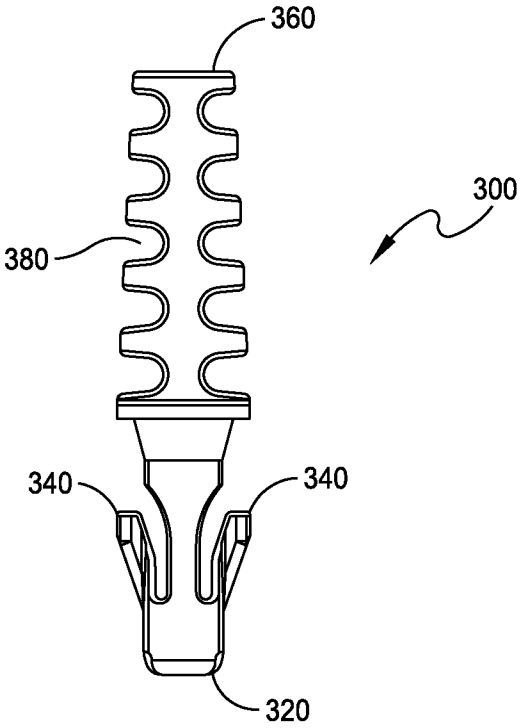
FIG. 4 is a top view of a wire retainer.

Referring to FIG. 4, in some implementations, the wire retainer 300 may be constructed of nylon or any other suitable material. The wire retainer 300 is configured to hold the wire 100 and tube 120 and snap into the frame member 200. The wire retainer 300 includes a first end 320 and a second end 360. The first end 320 includes arms 340 that are configured to engage with the openings 260 of the first and second connectors 220, 240 of the frame member 200. In some implementations, the wire retainer 300 may include openings 380 to improve flexibility, which may help relieve strain and avoid kinking. The exemplary wire retainer 300 shown defines the openings 380 as substantially U-shaped from a front view; however, other shapes and configurations are possible.

Figure 5:
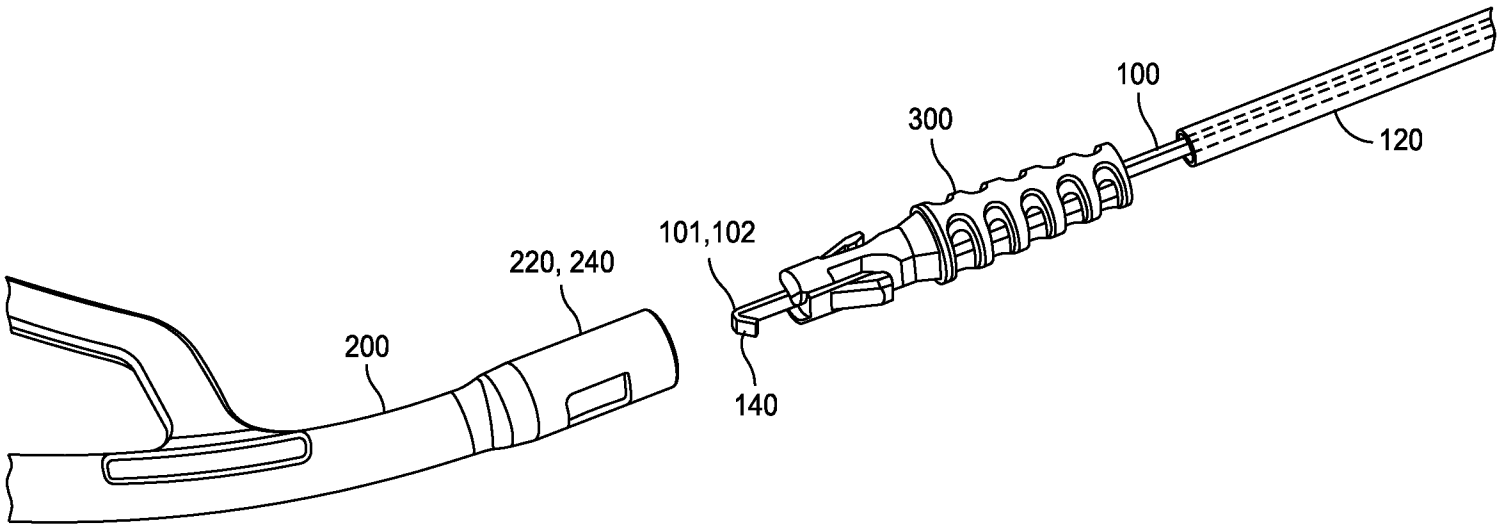
FIG. 5 is a side perspective view of a seat cover frame.
Figure 6:
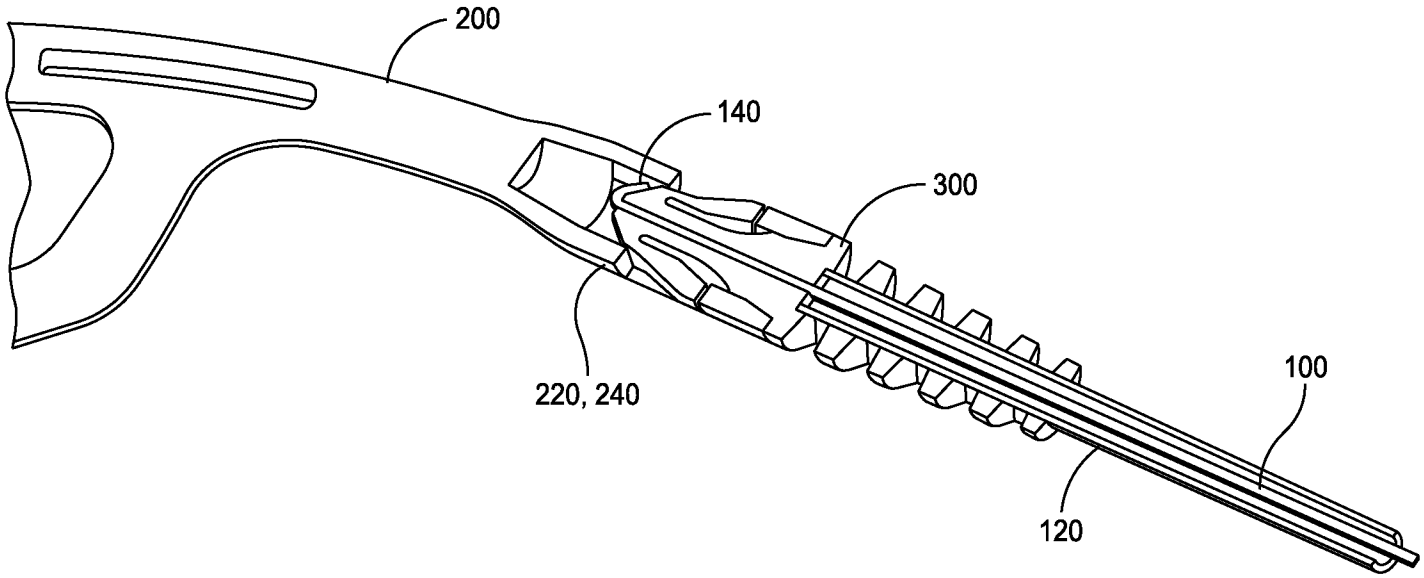
FIG. 6 is a side perspective, cross-sectional view of a seat cover frame.

Referring to FIGS. 5 and 6, in some implementations, the first and second ends 101, 102 of wire 100 include a hook 140 to secure the wire 100 to the wire retainer 300. As shown in FIG. 6, in some implementations, the wire 100 and the tube 120 are held within the wire retainer 300. This configuration may help prevent the wire 100 and the tube 120 from kinking.

Figure 7:
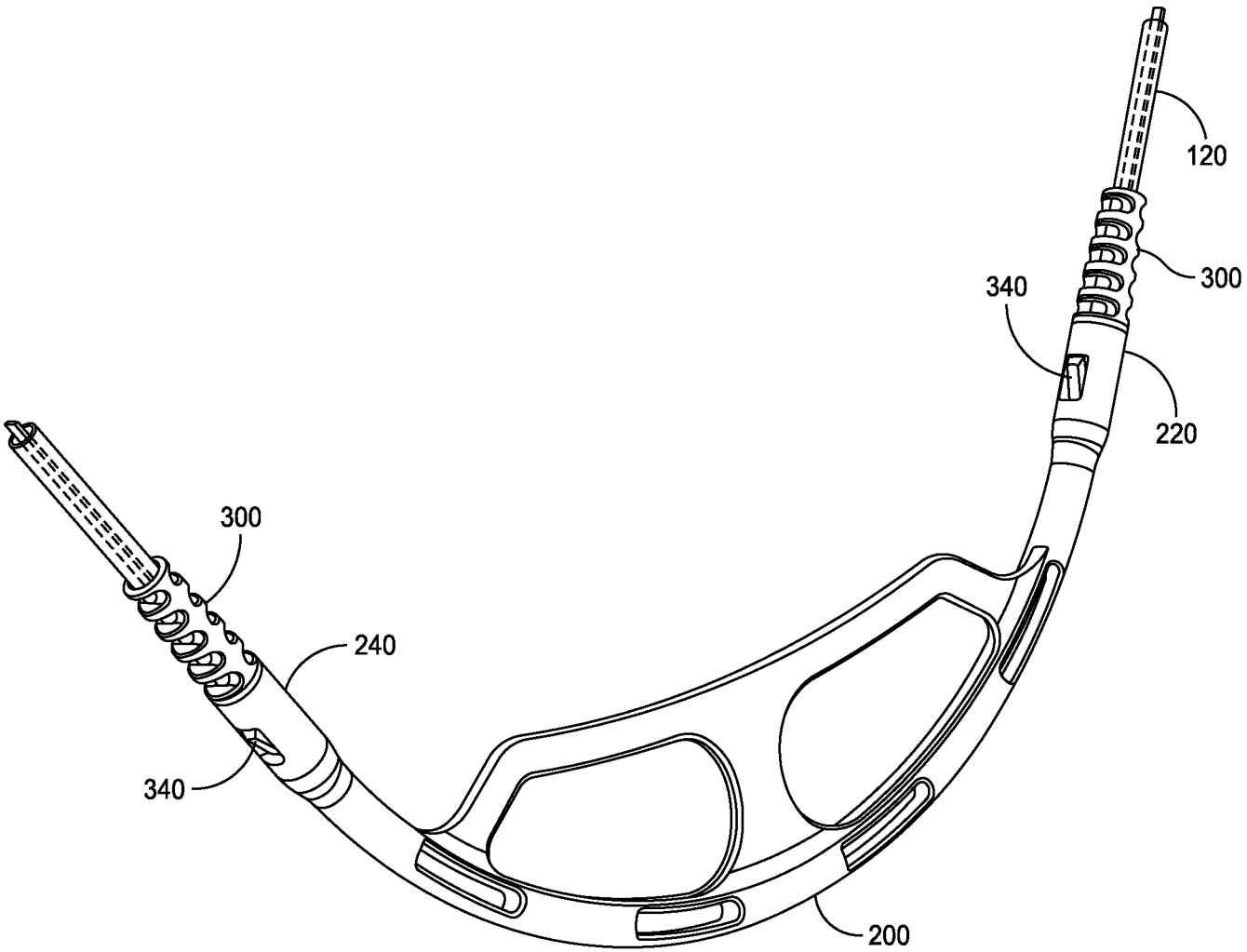
FIG. 7 is a side perspective view of a seat cover frame.

Referring to FIGS. 6 and 7, in some implementations, the wire retainer 300 is inserted into the first and connectors 220, 240 of the frame member 200 and the arms 340 engage with the openings 260. When the arms 340 engage with the openings 260, the wire retainer 300 snaps into the appropriate orientation and may help avoid rotation of the wire 100. The wire retainer 300 may help with the assembly of the seat cover frame 10. The exemplary seat cover frame 10 shown helps provide appropriate pre-load to the wire 100 and maintains the wire 100 and tube 120 in the appropriate orientation.

A number of implementations have been described. Nevertheless, it will be understood that various modifications may be made without departing from the spirit and scope of the disclosure. Accordingly, other implementations are within the scope of the following claims.

What is claimed is:

1. A frame for supporting a seat cover comprising:
a flexible wire with a first end and a second end;
a first wire retainer configured to receive the first end of the flexible wire, wherein the first wire retainer comprises a first projection that extends from the first wire retainer;
a second wire retainer configured to receive the second end of the flexible wire;
a plastic support configured to releasably receive the first wire retainer and the second wire retainer, wherein the plastic support comprises a first aperture receiving the first projection, and
wherein the first wire retainer comprises a plurality of openings configured to promote flexibility of the first wire retainer.

2. The frame of claim 1, wherein the plastic support defines a recess configured to receive the first wire retainer.

3. The frame of claim 1, wherein the second wire retainer comprises a second projection that extends from the second wire retainer, and the plastic support further comprises a second aperture configured to receive the second projection.

4. The frame of claim 1, further comprising a cover configured to attach to the flexible wire.

5. The frame of claim 1, wherein the first projection comprises an arm.

6. The frame of claim 1, wherein the first end of the flexible wire comprises a fastener configured to engage the first wire retainer.

7. The frame of claim 6, wherein the fastener comprises a hook.

8. The frame of claim 1, wherein the plurality of openings are u-shaped.

9. The frame of claim 1, wherein the plastic support comprises a first connector at a first end of the plastic support and a second connector at a second end of the plastic support.

10. The frame of claim 9, wherein the first connector comprises a recess configured to receive the first wire retainer.

11. The frame of claim 10, wherein the first wire retainer comprises a projection that extends from the first wire retainer, and the first connector comprises a first aperture configured to receive the first projection.

12. The frame of claim 1, wherein the first wire retainer comprises a sleeve through which the first end of the flexible wire passes.

13. The frame of claim 1, wherein the first wire retainer comprises a pair of projections extending from the first wire retainer, and the plastic support comprises a pair of apertures configured to receive the pair of projections.

14. The frame of claim 1, wherein the flexible wire is configured to be twisted into a compact position for storage.

15. The frame of claim 1, further comprising a tube, the flexible wire being at least partially enclosed in the tube.

16. A frame for supporting a seat cover comprising:
a flexible wire with a first end and a second end;
a first wire retainer configured to receive the first end of the flexible wire, wherein the first wire retainer comprises a plurality of openings configured to promote flexibility of the first wire retainer, and the first wire retainer comprises a first pair of arms that extend from the first wire retainer;
a second wire retainer configured to receive the second end of the flexible wire; and
a support configured to releasably receive the first wire retainer and the second wire retainer; wherein the support comprises a first pair of apertures configured to receive the first pair of arms.

17. The frame of claim 16, wherein the plurality of openings are u-shaped.

18. The frame of claim 16, wherein the second wire retainer comprises a second pair of arms that extend from the second wire retainer, and the support comprises a second pair of apertures configured to receive the second pair of arms.

19. The frame of claim 16, further comprising a cover configured to attach to the flexible wire.

20. The frame of claim 16, wherein the support comprises a first connector at a first end of the support and a second connector at a second end of the support, and wherein the first connector comprises a recess configured to receive the first wire retainer.

21. The frame of claim 16, wherein the first wire retainer comprises a sleeve through which the first end of the flexible wire passes.

22. The frame of claim 15, wherein the first wire retainer is configured to receive a first portion of the tube, and the second wire retainer is configured to receive a second portion of the tube.

23. A frame for supporting a seat cover comprising:
a flexible wire with a first end and a second end;
a first wire retainer configured to receive the first end of the flexible wire, wherein the first wire retainer comprises a plurality of openings configured to promote flexibility of the first wire retainer, and the first end of flexible wire comprises a hook configured to pass through and engage the first wire retainer;
a second wire retainer configured to receive the second end of the flexible wire; and
a support configured to releasably receive the first wire retainer and the second wire retainer.

* * * * *